US005201241A

United States Patent [19]

Pollack, Jr.

[11] Patent Number: 5,201,241

[45] Date of Patent: Apr. 13, 1993

[54] WINDOW CRANK HANDLE APPARATUS

[76] Inventor: Edward Pollack, Jr., 17 Virginia Ave., Hudson, N.Y. 12534

[21] Appl. No.: 840,044

[22] Filed: Feb. 24, 1992

[51] Int. Cl.[5] ..... G05G 1/00

[52] U.S. Cl. ..... 74/528; 74/547; 74/548

[58] Field of Search ..... 74/528, 543, 547, 545, 74/557, 548; 16/111 R, 112, 124; 49/341; 403/93, 95, 96; 296/223

[56] References Cited

U.S. PATENT DOCUMENTS

| | | | |
|---|---|---|---|
| 1,999,457 | 4/1935 | Hoehn | 74/548 |
| 2,065,750 | 12/1936 | Safford | 74/528 |
| 2,355,932 | 8/1944 | Walton | 49/341 |
| 2,452,742 | 11/1948 | Franzene | 74/548 |
| 3,091,978 | 6/1963 | Rubinstein | 74/545 |
| 3,250,038 | 5/1966 | Steel | 49/341 |
| 4,117,568 | 10/1978 | Bullock | 16/110 R |
| 4,161,891 | 7/1979 | Bossert | 74/548 |
| 4,313,282 | 2/1982 | Hagemann et al. | 49/352 |
| 4,513,715 | 7/1985 | Wiens | 74/547 X |
| 4,615,236 | 10/1986 | Boots | 296/223 X |
| 4,794,730 | 1/1989 | Fischback | 49/130 |

FOREIGN PATENT DOCUMENTS

| | | | |
|---|---|---|---|
| 490288 | 1/1930 | Fed. Rep. of Germany | 74/548 |
| 412663 | 7/1934 | United Kingdom | 74/548 |

*Primary Examiner*—Rodney H. Bonck
*Assistant Examiner*—Ryan W. Massey
*Attorney, Agent, or Firm*—Leon Gilden

[57] ABSTRACT

A crank handle includes an extension cylinder secured to a shaft member of a window drive housing, with the extension cylinder including a second wall spaced from a first wall receiving the shaft. A second wall shaft extends into a handle cavity, with the handle cavity formed with a pivot block, with the pivot block including an axle pin directed into the pivot block, and the axle pin pivotally mounted relative to an upper distal portion of the handle. A lower distal portion of the handle includes a handle extension member arranged to rotatively drive the gear drive shaft.

5 Claims, 4 Drawing Sheets

WINDOW CRANK HANDLE APPARATUS

BACKGROUND OF THE INVENTION

1. Field of the Invention

The field of invention relates to window crank handle apparatus, and more particularly pertains to a new and improved window crank handle apparatus wherein the same is arranged to effect the rotative operation of a window crank gear drive housing and permit interfolding of the handle during periods of non-use.

2. Description of the Prior Art

The use of conventional window crank structure relative to a gear drive of a window assembly frequently positions the handle in awkward orientations relative to the gear drive housing and further sets forth the handle structure in awkward orientations relative to a window framework, wherein the crank handle has limited access. The instant invention attempts to overcome deficiencies of the prior art by providing structure to project the handle relative to a window framework and permit interfolding of the handle during periods of non-use.

Prior art window crank drive structure is exemplified in the U.S. Pat. Nos. 4,161,891; 4,117,568; 4,313,282; and 4,794,730.

Accordingly, it may be appreciated that there continues to be a need for a new and improved window crank handle apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of window crank apparatus now present in the prior art, the present invention provides a window crank handle apparatus wherein the same is arranged to effect extension of a crank handle relative to a drive mechanism and permit subsequent interfolding of the handle structure during periods of non-use. As such, the general purpose of the present invention, which will be described subsequently in greater detail, is to provide a new and improved window crank handle apparatus which has all the advantages of the prior art window crank apparatus and none of the disadvantages.

To attain this, the present invention provides a crank handle including an extension cylinder secured to a shaft member of a window drive housing, with the extension cylinder including a second wall spaced from a first wall receiving the shaft. A second wall shaft extends into a handle cavity, with the handle cavity formed with a pivot block, with the pivot block including an axle pin directed into the pivot block, and the axle pin pivotally mounted relative to an upper distal portion of the handle. A lower distal portion of the handle includes a handle extension member arranged to rotatively drive the gear drive shaft.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved window crank handle apparatus which has all the advantages of the prior art window crank apparatus and none of the disadvantages.

It is another object of the present invention to provide a new and improved window crank handle apparatus which may be easily and efficiently manufactured and marketed.

It is a further object of the present invention to provide a new and improved window crank handle apparatus which is of a durable and reliable construction.

An even further object of the present invention is to provide a new and improved window crank handle apparatus which is susceptible of a low cost of manufacture with regard to both materials and labor, and which accordingly is then susceptible of low prices of sale to the consuming public, thereby making such window crank handle apparatus economically available to the buying public.

Still yet another object of the present invention is to provide a new and improved window crank handle apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
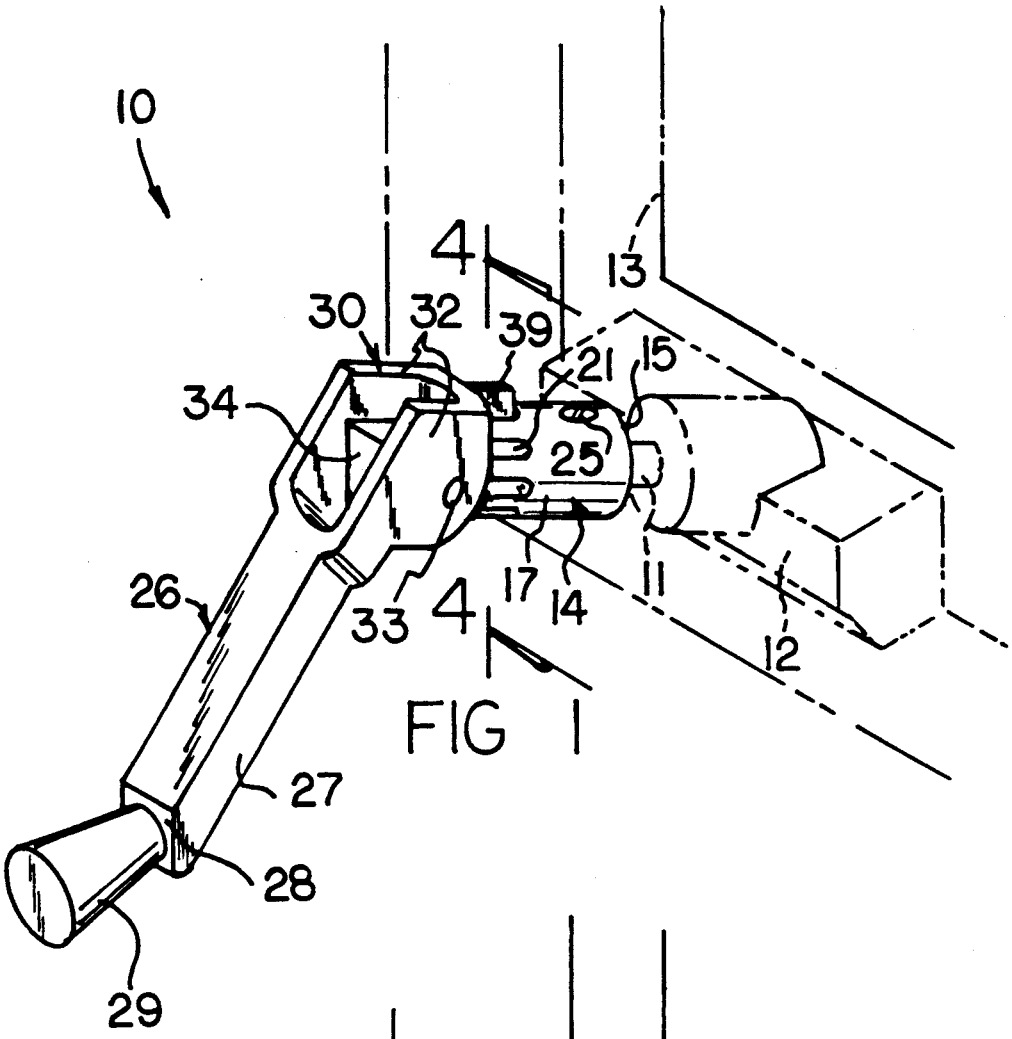
FIG. 1 is an isometric illustration of the instant invention in a first position.

With reference now to the drawings, and in particular to FIGS. 1 to 7 thereof, a new and improved window crank handle apparatus embodying the principles and concepts of the present invention and generally designated by the reference numeral 10 will be described.

More specifically, the window crank handle apparatus 10 of the instant invention essentially comprises a window gear drive housing 12 mounted within a window framework, including a shaft 11, the shaft 11 upon rotation is arranged to effect pivotment of a window frame 13 within the window framework, in a manner known in the prior art. The shaft 11 is received within an extension cylinder 14, wherein the extension cylinder 14 is defined along a cylindrical axis 14*a* (see FIG. 3), including a first end wall 15 spaced from and parallel a second end wall 16, with the first and second end walls arranged orthogonally relative to the axis 14*a*. The extension cylinder 14 is formed with a cylindrical outer wall 17. A second wall shaft 19 coaxially and integrally mounted to the second wall 16 extends longitudinally of the axis 14*a* and the second end wall 16. The second wall shaft 19 is formed with an annular groove 20 spaced from the free distal end of the second wall shaft 19, wherein a series of radial slots 21 equally spaced relative to one another project into the extension cylinder 14 through the second end wall 16 and the outer wall 17 for inter-engaging and locking a lock flange 39 mounted to the handle member 26. First end wall bore 22 coaxially aligned relative to the axis 14*a* is directed into the first end wall 15 and is formed with a series of internal bore splines 23 (see FIG. 5) to accommodate a typically splined shaft 11. An intersecting internally threaded lock bore 24 is radially directed through the extension cylinder 14 intersecting the first end wall bore 22, with a lock screw 25 threadedly received within the lock bore 24 for engaging and locking the shaft 11 within the first end wall bore 22.

Figure 2:
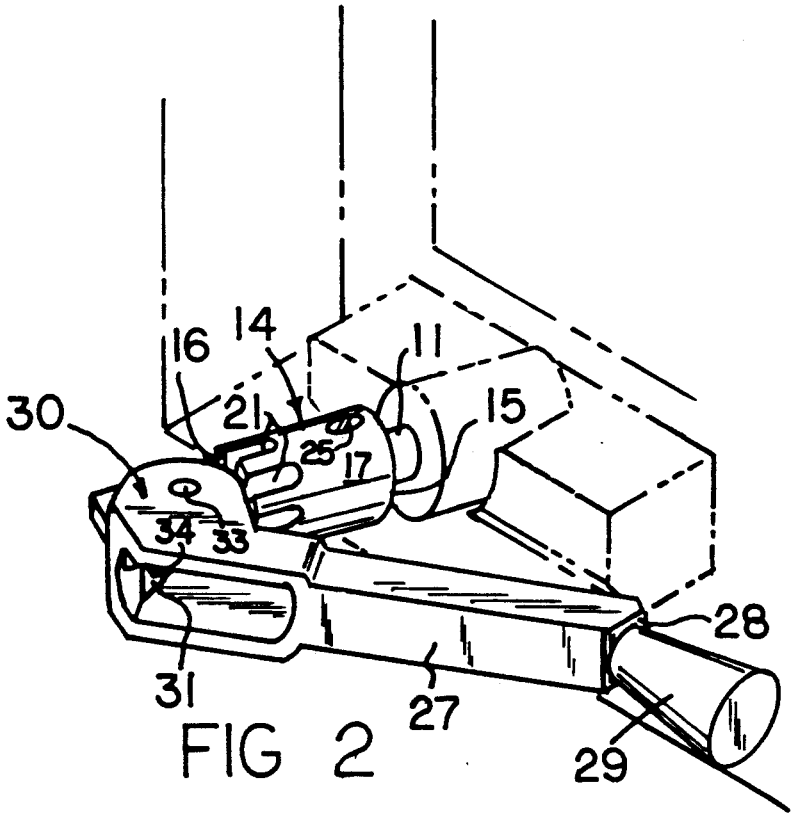
FIG. 2 is an isometric illustration of the invention in a second interfolded position.
Figure 3:
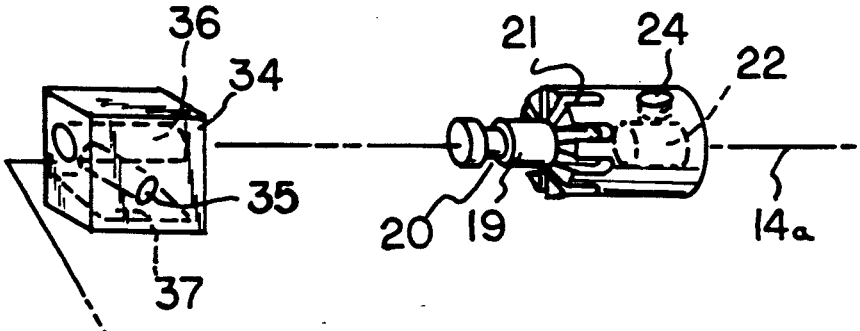
FIG. 3 is an isometric exploded view of the instant invention.
Figure 4:
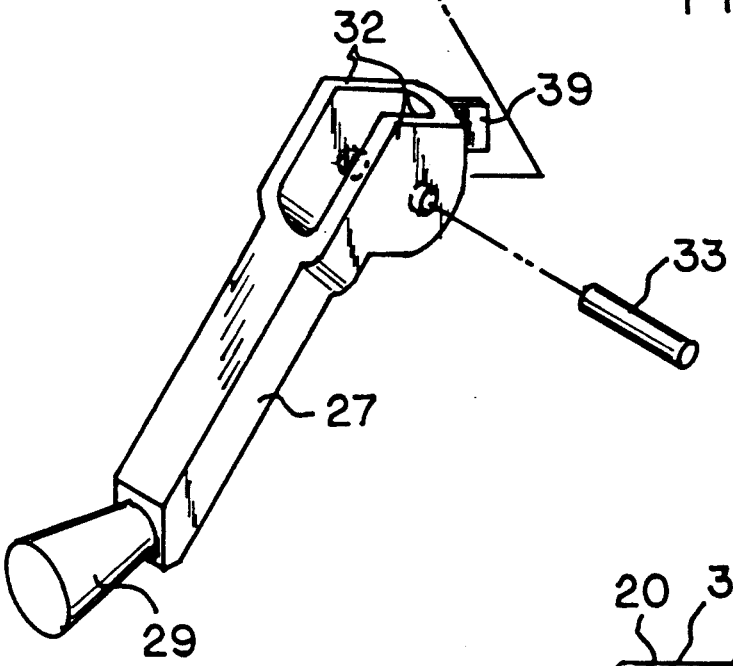
FIG. 4 is an orthographic side view of the instant invention.
Figure 4:
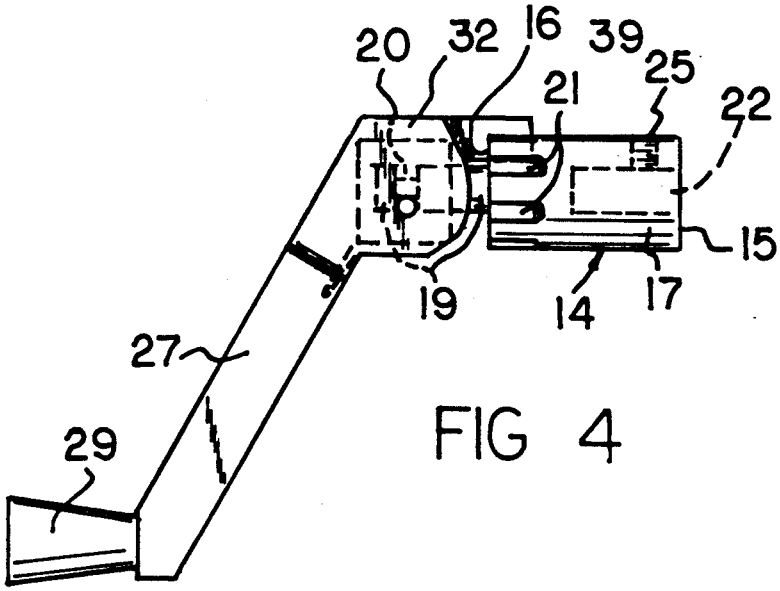
Figure 5:
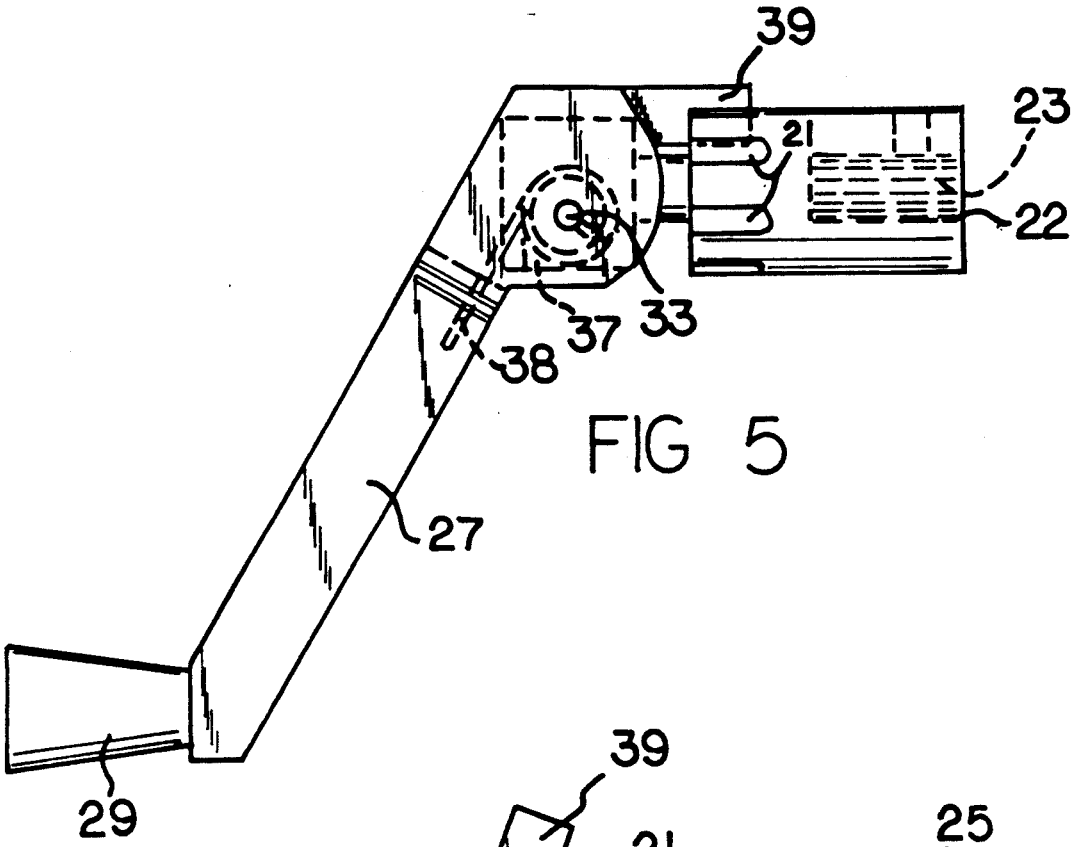
FIG. 5 is an orthographic side view of the invention illustrating the use of a biasing spring contained therewithin.

A handle member 26 is provided, such as illustrated in FIG. 1, to include an elongate handle shank 27, with a shank lower end 28 mounting a shank projecting knob 29 therefrom formed at an obtuse included angle between the shank 27 and the projecting knob 29. A support boss 30 is fixedly mounted to the upper end of the shank 27 defining an equal obtuse included angle between the support boss 30 and the shank 27, with the support boss 30 arranged parallel relative to the projecting knob 29. A support boss cavity 31 is formed defined between spaced parallel boss flanges 32. An axle pin 33 is orthogonally directed through the boss flanges 32 and orthogonally directed through a pivot block 34 that is received within the support boss 30 between the boss flanges 32. A pivot block axle pin bore 35 receives the axle pin 33 therethrough, with a second wall shaft receiving bore 36 directed into the pivot block 34 to receive the second wall shaft 19 therewithin, with the pivot block axle pin 33 directed into the pivot block axle pin bore 35 and received within the second wall shaft annular groove 20, in a manner as illustrated in FIG. 4. In this manner, pivotment of the handle shank 27 is permitted about the axle pin 33. In use, the handle member 26 is pivoted to the first position, as illustrated in FIG. 1, to engage the lock flange 39 projecting longitudinally and exteriorly of the support boss 30 within one of the radial slots 21. Disengagement of the lock flange 39 relative to the radial slots 21 permits interfolding of the handle to the second position, as illustrated in FIG. 2.

Figure 6:
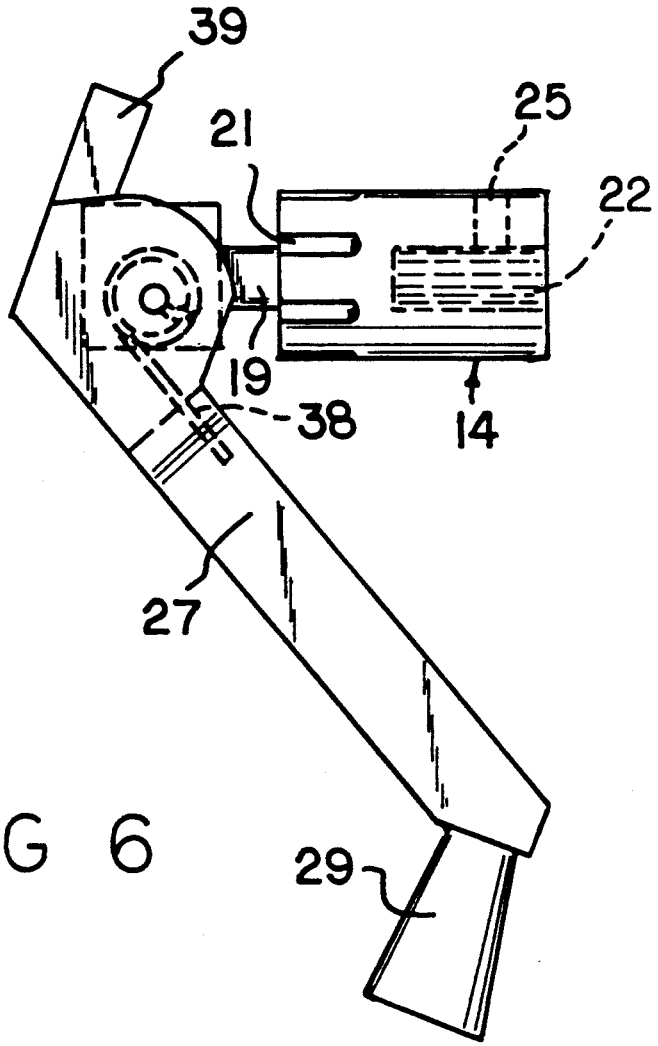
FIG. 6 is an orthographic side view of the invention, with the biasing spring biasing the handle in the second position.

A coil spring 38 is provided as an optional member directed into a pivot block cavity 37, with a first end of the coil spring 38 secured to the handle shank 27 and a second end of the coil spring 38 mounted to the axle pin 33 to normally bias the handle to the second position, as illustrated in FIG. 6, to provide for a compact interfolded relationship of the organization during periods of non-use.

Figure 7:
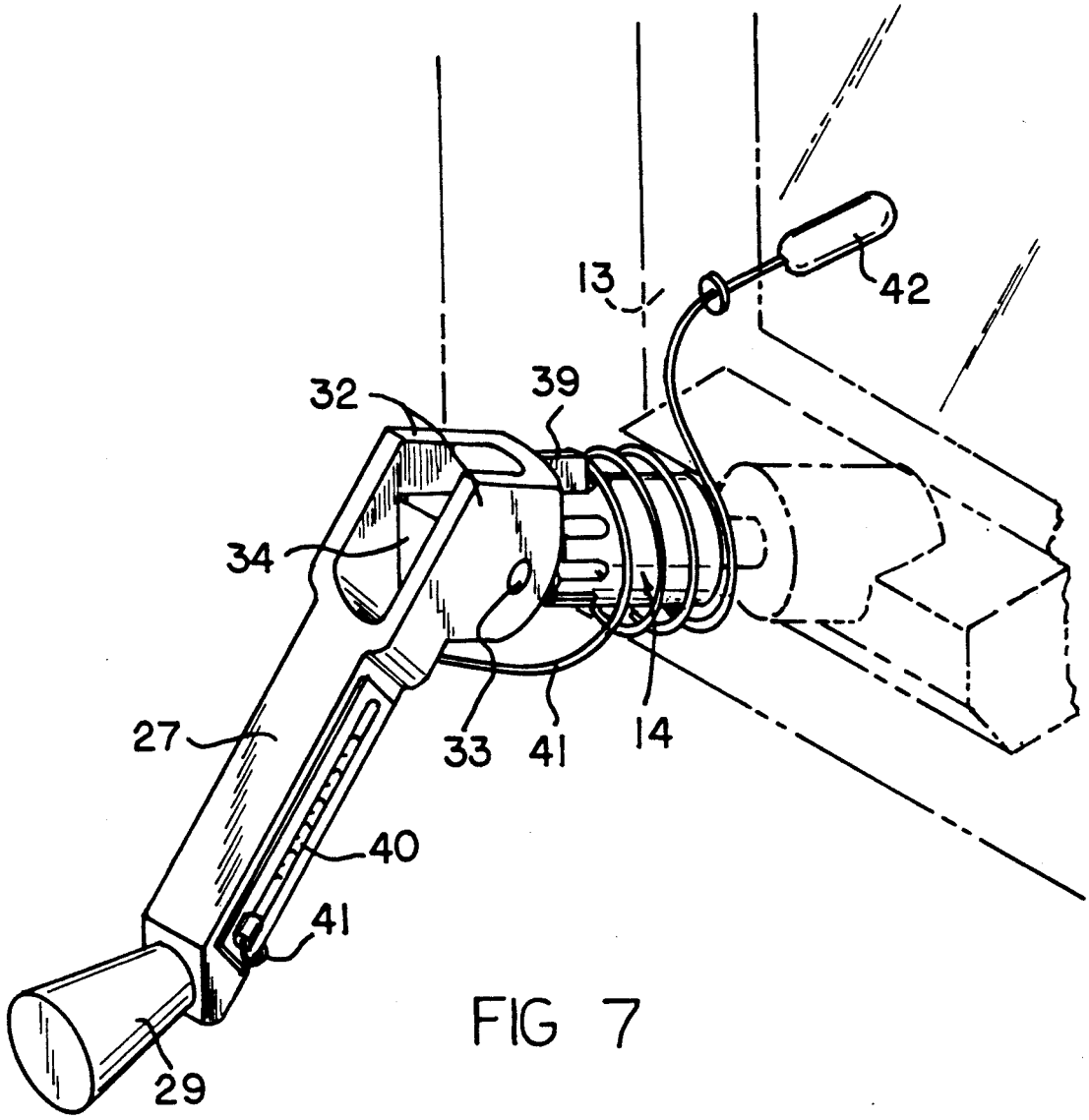
FIG. 7 is an isometric illustration of the invention utilizing a temperature sensing mechanism associated therewith.

The apparatus, as illustrated in FIG. 7, further includes a thermometer 40 mounted fixedly to the handle shank 27 in communication with a flexible conductor cable 41 wound about the extension cylinder 14 and directed through the window frame 13, with a sensor bulb 42 positioned exteriorly of the window frame to provide for visual indication of temperature interiorly of a dwelling. The flexible cable 41 permits the furling and unfurling of the cable about the extension cylinder 14.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A window crank handle apparatus arranged for mounting to a gear drive shaft to effect pivotment of a window frame within a window framework, wherein the apparatus comprises, an extension cylinder, the extension cylinder defined along a predetermined axis, with the extension cylinder including a first end wall spaced from a second end wall, and a cylindrical outer wall, and the second end wall including a second wall shaft coaxially aligned relative to the predetermined axis extending longitudinally and exteriorly of the extension cylinder, and a handle member, the handle member including a handle shank, with the handle shank including a lower end and an upper end, the lower end including a projecting knob mounted to the lower end at a predetermined obtuse angle defined between the projecting knob and the handle shank, and a support boss projecting beyond the shank mounted to the upper end of the shank defining a predetermined obtuse angle between the shank and the support boss, with the support boss oriented parallel relative to the projecting knob, and the support boss including a support boss cavity, the support boss further including spaced parallel boss flanges defining the support boss cavity therebetween, and a pivot block mounted within the support boss cavity, the pivot block including a second wall shaft receiving bore directed in the pivot block, with the second wall shaft receiving bore receiving the second wall shaft therewithin, and a pivot block axle pin bore orthogonally oriented relative to the second wall shaft receiving bore, with the pivot block axle pin bore including an axle pin, with the axle pin orthogonally intersecting the boss flanges and received within the pivot block axle pin bore, and the axle pin bore intersecting the second wall shaft receiving bore, the second wall shaft including an annular groove, and the pivot block axle pin bore and the axle pin received within the annular groove.

2. An apparatus as set forth in claim 1 wherein the extension cylinder includes a plurality of radial slots directed into the extension cylinder through the second end wall and the outer wall, and a lock flange fixedly mounted to the support boss projecting beyond the support boss for reception within one of said radial slots upon pivotment of the handle member to a first position, with the lock flange displaced from the radial slots in a second position, with the shank interfolded in adjacency relative to the extension cylinder.

3. An apparatus as set forth in claim 2 including a coil spring received within the pivot block, the coil spring including a coil spring first end fixedly mounted to the handle shank, and the coil spring second end fixedly mounted to the axle pin to bias the handle shank to the second position.

4. An apparatus as set forth in claim 3 with the extension cylinder including a first end wall bore directed into the first end wall coaxially aligned relative to the predetermined axis to receive the shaft therewithin, and an internally threaded intersecting lock bore intersecting the first end wall bore, and a lock screw threadedly directed through the internally threaded lock bore to intersect and be received within the first end wall bore for engagement with the shaft.

5. An apparatus as set forth in claim 4 including a thermometer mounted to the shank, and a flexible thermometer conductor cable wound about the extension cylinder mounted to the thermometer, and a sensor bulb mounted to the conductor cable spaced from the thermometer for positionment exteriorly of the window frame.

* * * * *